US009677795B2

(12) United States Patent
Hartfield et al.

(10) Patent No.: US 9,677,795 B2
(45) Date of Patent: Jun. 13, 2017

(54) REFRIGERANT MANAGEMENT IN A HVAC SYSTEM

(71) Applicant: TRANE INTERNATIONAL INC., Piscataway, NJ (US)

(72) Inventors: Jon Phillip Hartfield, La Crosse, WI (US); Harry Kenneth Ring, Houston, MN (US); Lee L. Sibik, Onalaska, WI (US); Benjamin Elias Dingel, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 14/654,778

(22) PCT Filed: Dec. 20, 2013

(86) PCT No.: PCT/US2013/077070

§ 371 (c)(1),
(2) Date: Jun. 22, 2015

(87) PCT Pub. No.: WO2014/100654

PCT Pub. Date: Jun. 26, 2014

(65) Prior Publication Data

US 2015/0354873 A1 Dec. 10, 2015

Related U.S. Application Data

(60) Provisional application No. 61/740,702, filed on Dec. 21, 2012.

(51) Int. Cl.
*F25B 39/00* (2006.01)
*F25B 49/00* (2006.01)
(Continued)

(52) U.S. Cl.
CPC ..... *F25B 39/00* (2013.01); *F25B 31/004* (2013.01); *F25B 40/02* (2013.01); *F25B 49/00* (2013.01);
(Continued)

(58) Field of Classification Search
CPC ..... F25B 31/004; F25B 39/02–39/028
See application file for complete search history.

(56) References Cited

U.S. PATENT DOCUMENTS 3,315,481 A 4/1967 Check et al.
3,381,491 A 5/1968 Harnish
(Continued)

FOREIGN PATENT DOCUMENTS

CN 1745282 A 3/2006
CN 101338961 A 1/2009
(Continued)

OTHER PUBLICATIONS

International Search Report and Written Opinion for International Application No. PCT/US2013/077070, Dated Mar. 24, 2014, 10pgs.

*Primary Examiner* — Allana Lewin Bidder
*Assistant Examiner* — Antonio R Febles
(74) *Attorney, Agent, or Firm* — Hamre, Schumann, Mueller & Larson, P.C.

(57) ABSTRACT

Methods and systems to manage refrigerant levels in a chiller system are provided. An evaporator of the chiller system may be configured to have a spill over port allowing oil containing refrigerant to spill over through the spill over port. The spill over port may be positioned at a place that corresponds to a desired refrigerant level in the evaporator. The spill over refrigerant may be directed into a heat exchanger that is configured to substantially vaporize refrigerant of the spill over refrigerant to a slightly superheat temperature. A method of maintaining a proper refrigerant level in the evaporator may include regulating a refrigerant flow to the evaporator so that the vaporized refrigerant of the spill over refrigerant is maintained at the slightly superheat temperature.

22 Claims, 3 Drawing Sheets

(51) Int. Cl.

| | |
|---|---|
| ***F25B 31/00*** | (2006.01) |
| ***F25B 40/02*** | (2006.01) |
| ***F25B 49/02*** | (2006.01) |
| *F25B 39/02* | (2006.01) |
| *F25B 39/04* | (2006.01) |

(52) U.S. Cl.

CPC ..... *F25B 49/02* (2013.01); *F25B 39/02* (2013.01); *F25B 39/04* (2013.01); *F25B 2339/046* (2013.01); *F25B 2600/05* (2013.01); *F25B 2600/2513* (2013.01); *F25B 2700/04* (2013.01); *F25B 2700/21175* (2013.01)

(56) References Cited

U.S. PATENT DOCUMENTS

| | | | | |
|---|---|---|---|---|
| 3,399,544 | A | 9/1968 | Osborne | |
| 5,561,987 | A | 10/1996 | Hartfield et al. | |
| 5,778,695 | A | 7/1998 | Ring et al. | |
| 6,035,651 | A | 3/2000 | Carey | |
| 6,857,287 | B1 | 2/2005 | Alsenz | |
| 7,621,141 | B2 * | 11/2009 | McCormick | B60H 1/3205 62/218 |
| 2002/0066286 | A1 * | 6/2002 | Alsenz | F25B 1/00 62/498 |
| 2006/0059926 | A1 | 3/2006 | McCormick et al. | |
| 2007/0163276 | A1 | 7/2007 | Braun et al. | |
| 2008/0307810 | A1 * | 12/2008 | VanderZee | F25B 49/02 62/222 |
| 2011/0308267 | A1 * | 12/2011 | Tamaki | F25B 45/00 62/222 |

FOREIGN PATENT DOCUMENTS

| | | | | |
|---|---|---|---|---|
| CN | 201306892 | Y | 9/2009 | |
| CN | 102032731 | A | 4/2011 | |
| GB | 622043 | A * | 4/1949 | F25B 31/004 |
| JP | 2012-163299 | | 8/2012 | |
| KR | 10-1065515 | | 9/2011 | |
| KR | 10-2012-0041186 | | 4/2012 | |

* cited by examiner

REFRIGERANT MANAGEMENT IN A HVAC SYSTEM

FIELD

The disclosure herein relates to heating, ventilation, and air-conditioning ("HVAC") systems, and more particularly to heat exchangers (such as evaporators and condensers) in HVAC systems. Generally, methods, systems and apparatuses are described that are directed to fluid (such as refrigerant and/or oil) management in an evaporator and/or a compressor such as may be used in HVAC chillers.

BACKGROUND

A HVAC system can have a chiller that typically includes a compressor, heat exchangers such as a condenser, an evaporator, and an expansion device forming a refrigeration circuit. Refrigerant vapor is generally compressed by the compressor, and then condensed into liquid refrigerant in the condenser. The liquid refrigerant is then expanded by the expansion device (e.g. expansion valve) to become low-pressure low-temperature two-phase refrigerant and is directed into the evaporator; and the two-phase refrigerant can then exchange heat with a process fluid, such as water, in the evaporator. The two-phase refrigerant may be vaporized in the evaporator and return to the compressor.

In a chiller, the condenser and/or the evaporator can be a tube-and-shell type heat exchanger. The condenser and/or the evaporator can maintain certain levels of liquid refrigerant in the shell in operation. Maintaining a proper level of liquid refrigerant in the condenser and/or the evaporator may help increase operational efficiency of the chiller.

SUMMARY

Systems and methods are provided for controlling refrigerant levels in heat exchangers (e.g. a condenser and an evaporator) of a chiller system. Embodiments disclosed herein can help maintain, for example, an optimal refrigerant level in the heat exchangers, improve operational efficiency of the chiller system, maintain proper lubrication in the compressor, and/or maintain a proper oil concentration in the evaporator.

In some embodiments, the evaporator of the chiller system may be equipped with a spill over port allowing refrigerant to spill over through the evaporator. In some embodiments, the spill over port may be positioned at a height relative to a bottom of the evaporator that is equivalent to a desired liquid refrigerant level in the evaporator. In operation, when the operational liquid refrigerant level in the evaporator is at about the desired liquid refrigerant level, some liquid refrigerant may be spilled over through the spill over port. An amount of the spill over refrigerant may be correlated to the liquid refrigerant level in the evaporator. In some embodiments, the evaporator may include a tube bundle, and the spill over port may be configured to be positioned at a place corresponding to a height of a top tube row of the tube bundle from the bottom of the evaporator.

In some embodiments, the spill over refrigerant may be directed into a heat exchanger. In some embodiments, the heat exchanger may be configured to receive a heat source to vaporize refrigerant of the spill over refrigerant. In some embodiments, the heat source may be refrigerant directed out of the condenser. The chiller system may also include a temperature sensor that is configured to measure a temperature of, for example the vaporized refrigerant of the spill over refrigerant departing the heat exchanger. In some embodiments, the chiller system may also include an expansion device configured to regulate a refrigerant flow to the evaporator. In some embodiments, the chiller system may be configured to regulate the refrigerant flow according to the temperature of the vaporized refrigerant of the spill over refrigerant departing the heat exchanger.

In some embodiments, the refrigerant flow to the evaporator may be regulated so that the temperature of the vaporized refrigerant of the spill over refrigerant is maintained at a slightly superheat temperature, such as about 1 to about 10° C. superheat.

In some embodiments, the chiller system may include a refrigerant level measuring device configured to measure a liquid refrigerant level in the condenser. In some embodiments, the chiller system may be configured to regulate the refrigerant flow to the evaporator so as to maintain the liquid refrigerant level in the condenser at a condenser liquid refrigerant level setpoint.

In some embodiments, a method of operating a chiller system may include allowing refrigerant to spill over through a spill over port of an evaporator of the chiller system, wherein an amount of the spill over refrigerant may correlate to a refrigerant level in the evaporator. The method may also include vaporizing refrigerant of the spill over refrigerant with a heat source, measuring a temperature of the vaporized refrigerant of the spill over refrigerant and changing a refrigerant flow to the evaporator so that the temperature of the vaporized refrigerant of the spill over refrigerant is maintained at, for example, a desired temperature set valve.

In some embodiments, the method may further include positioning the spill over port at a height relative to a bottom of the evaporator that corresponds to a desired liquid refrigerant level in the evaporator. In some embodiments, the method may include measuring the liquid refrigerant level in the condenser; and changing the refrigerant flow to the evaporator so that the measured liquid refrigerant level is maintained at a condenser liquid refrigerant level setpoint.

In some embodiments, the method may include reducing the liquid refrigerant level setpoint in the condenser, when the temperature of the vaporized refrigerant of the spill over refrigerant increases; and increasing the liquid refrigerant level setpoint in the condenser, when the temperature of the vaporized refrigerant of the spill over refrigerant decreases. In some embodiments, the method may include providing an alert when the liquid refrigerant level setpoint is below a refrigerant level threshold.

Other features and aspects will become apparent by consideration of the following detailed description and accompanying drawings.

BRIEF DESCRIPTION OF THE DRAWINGS

Reference is now made to the drawings in which like reference numbers represent corresponding parts throughout.

FIG. 1A is a schematic diagram of a chiller system. FIG. 1B is a schematic side view of an evaporator of the chiller system.

DETAILED DESCRIPTION

Figure 1A:
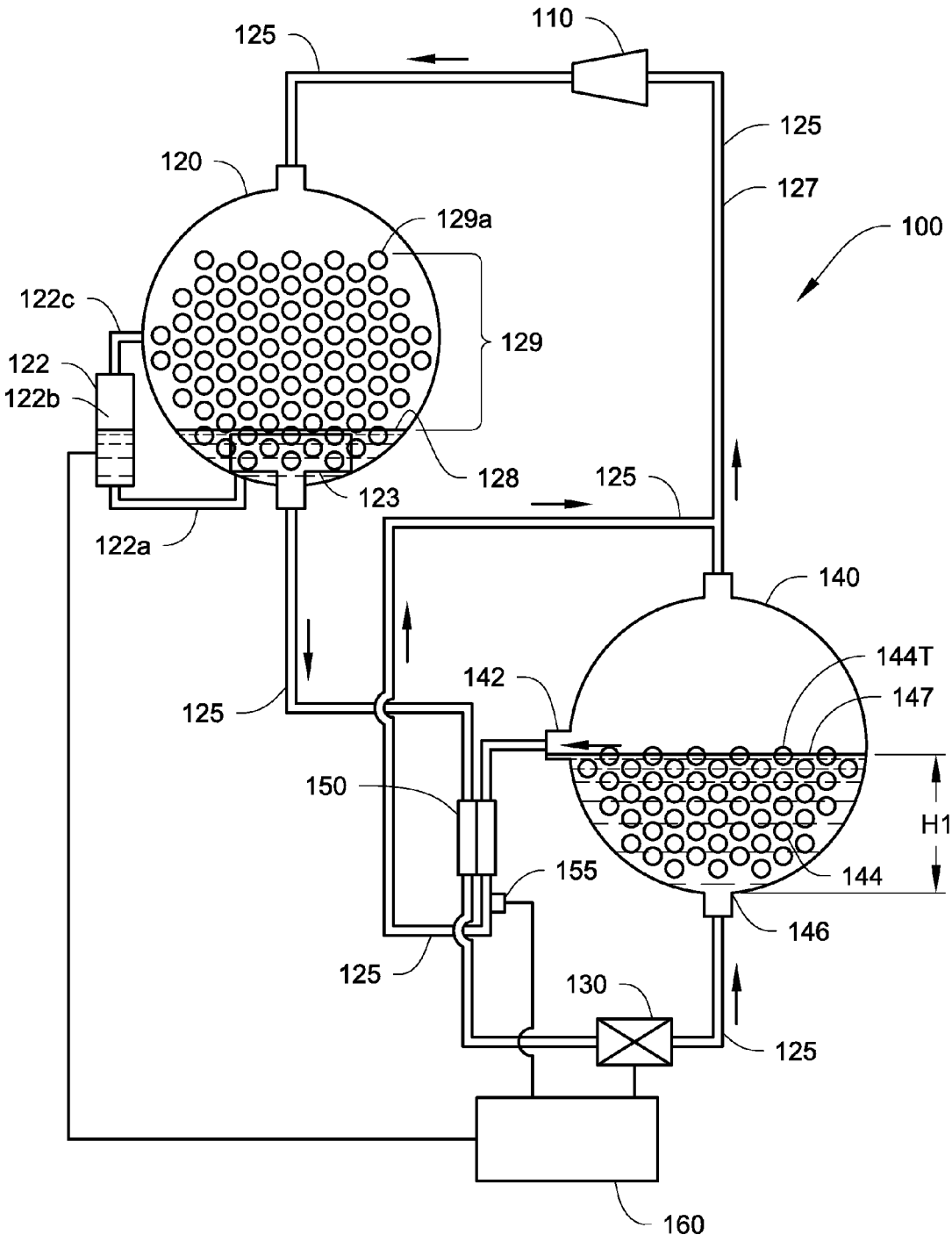
FIGS. 1A and 1B illustrate an embodiment of a chiller system.

A chiller, particularly a chiller with tube-and-shell type heat exchangers, such as a condenser and/or an evaporator, may require managing a refrigerant level in the heat exchangers. The tube-and-shell heat exchangers may contain liquid refrigerant inside a shell of the heat exchanger. Managing the refrigerant level inside the shell may help improve operation efficiency of the chiller. For example, some condensers may have a subcooling section at an inner bottom of the condenser shell and a condensing section above the subcooling section. It may be desirable to maintain a refrigerant level that is sufficient to submerge the subcooling section inside the condenser shell, but not submerge the condensing section. When the refrigerant level is managed in the condenser, the condensing section can condense the refrigerant relatively effectively and the subcooling section can subcool the refrigerant relatively effectively, which can result in, for example, an optimal operation efficiency in the condenser.

Some evaporators, such as a flooded evaporator, may be configured to have a plurality of heat exchange tubes running across an inner space of the evaporator shell. It may be desirable to maintain a refrigerant level that is just sufficient to wet all the heat exchange tubes inside the evaporator shell. Excessive refrigerant in the evaporator may, for example, increase the refrigerant pressure drop through the heat exchange tubes, causing capacity reduction in the chiller. When the refrigerant level is too low, the heat exchange efficiency between the heat exchange tubes and the refrigerant in the evaporator may drop.

When in operation, it may be also desirable to distribute (and/or balance) the refrigerant between the condenser and the evaporator properly. For example, in some embodiments, the optimal refrigerant levels for the condenser and for the evaporator may change according to a load of the chiller. At a full load, the optimal refrigerant level may be greater than the optimal refrigerant level at a reduced load in the condenser. The optimal refrigerant level at a full load may be lower than the optimal refrigerant level at a reduced load in the evaporator. Therefore, as the chiller load is reduced, it may be desirable to lower the condenser refrigerant level but increase the evaporator refrigerant level; and when the chiller load is increased, it may be desirable to increase the condenser refrigerant level but reduce the evaporator refrigerant level.

The refrigerant may be mixed with a lubricant, such as for example lubricating oil, for a compressor in operation. Often, the lubricating oil is present in the evaporator, mixed with the liquid refrigerant in the evaporator. It may be desirable to direct at least some of the liquid refrigerant/oil mix out of the evaporator, and back to the compressor (or an oil tank or an oil separator of the compressor). Directing oil (or oil/refrigerant mix) back to the compressor (or the oil tank or oil separator) can help lubricate the compressor, prevent the compressor from running out of oil, and/or maintain a proper oil content in the refrigerant of the evaporator.

Systems and methods configured to help manage the refrigerant levels in the condenser and/or the evaporator may help increase the operation efficiency of the chiller, help maintain a proper lubricating oil concentration in the evaporator and/or help lubricate the compressor.

Methods and systems to manage refrigerant levels in a chiller system are described herein. In some embodiments, an evaporator of the chiller system may have a spill over port that is configured to allow oil containing refrigerant to spill out of the evaporator through the spill over port. The spill over port may be positioned at a place that corresponds to a desired refrigerant level in the evaporator. The spill over refrigerant may be directed into a heat exchanger that is configured to vaporize refrigerant of the spill over refrigerant to, for example, a slightly superheat temperature. The evaporator may be equipped with an expansion device (e.g. expansion valve) configured to control a refrigerant flow to the evaporator. A method of maintaining a proper refrigerant level in the evaporator may include regulating a refrigerant flow to the evaporator so that the vaporized refrigerant of the spill over refrigerant is maintained at the slightly superheat temperature. When refrigerant in the spill over refrigerant is vaporized, the spill over refrigerant may have a relatively high oil content relative to the liquid content of the spill over refrigerant. The spill over refrigerant including the relatively high oil content can be directed back to the compressor to help lubricate the compressor.

The chiller system may also include a condenser equipped with a refrigerant level measuring device. The refrigerant level measuring device may be configured to measure a refrigerant level in the condenser. The refrigerant flow to the evaporator may also be controlled so that the refrigerant level in the condenser is maintained at, for example, a desired refrigerant level setpoint.

Methods utilizing both the temperature of the vaporized refrigerant of the spill over refrigerant to control the refrigerant level in the evaporator and oil return from the evaporator and the refrigerant level measuring device to control the refrigerant level in the condenser are described herein. The methods may help balance the refrigerant levels between the condenser and the evaporator during operation, for example, based on load conditions of the chiller system. The methods can also help detect refrigerant leakage in the chiller system.

References are made to the accompanying drawings that form a part hereof, and in which is shown by way of illustration of the embodiments in which the embodiments may be practiced. The phrases "upstream" and "downstream" are referred relatively to a flow direction. Refrigerant as described herein may generally include contents other than the refrigerant. For example, refrigerant may contain oil. It is to be understood that the terms used herein are for the purpose of describing the figures and embodiments and should not be regarding as limiting the scope of the present application.

Figure 1B:
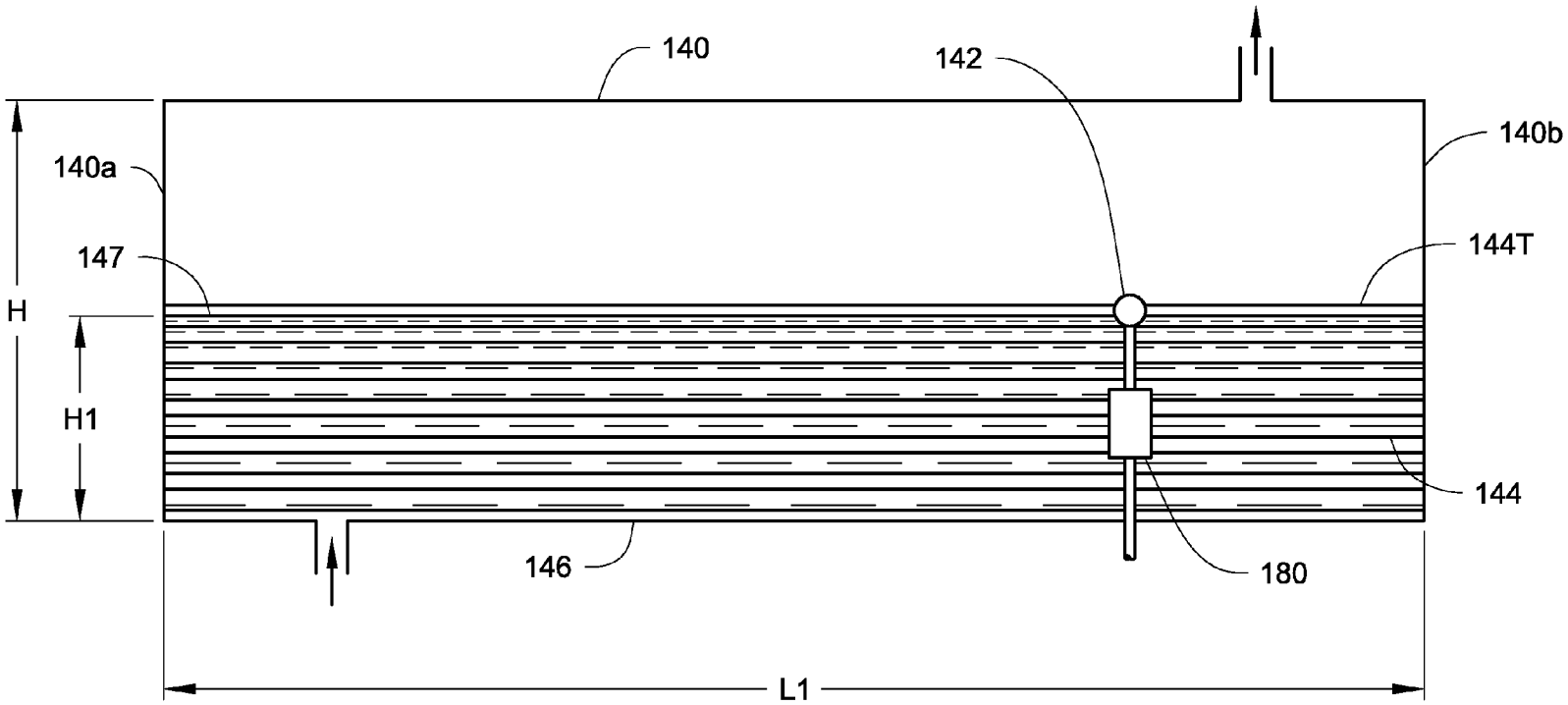

FIGS. 1A and 1B illustrate an embodiment of a chiller system 100. FIG. 1A is a schematic view of the chiller system 100. The chiller system 100 includes a compressor 110, a condenser 120, an expansion device 130 and an evaporator 140 connected by refrigerant lines 125 to form a refrigeration circuit. The condenser 120 and the evaporator 140 can be a tube-and-shell type heat exchanger. The condenser 120 is equipped with a liquid refrigerant level measuring device 122 that is configured to measure a liquid refrigerant level 128 in the condenser 120. The liquid refrigerant level measuring device 122 in the illustrated embodiment includes a connection line 122*a* that is configured to form a fluid communication passage between the condenser 120 and a measuring chamber 122*b* of the liquid refrigerant level measuring device 122. In some embodiments, the chiller system 100 also includes a controller 160 and a heat exchanger 150.

In the embodiment as shown in FIG. 1A, the condenser 120 includes a subcooling section 123 and a condensing section 129. The condensing section 129 primarily includes gaseous refrigerant and the subcooling section 123 primarily includes liquid refrigerant. The liquid refrigerant level 128 may be desirably configured to submerge the subcooling section 123 but not to submerge tubes 129*a* in the condensing section 129 of the condenser 120. It is to be appreciated that the desired refrigerant level in the condenser 120 may vary according to a load of the chiller system 100.

The liquid refrigerant level measuring device 122 also includes a return line 122*c* that is configured to allow the measuring chamber 122*b* to vent gas (such as gaseous refrigerant) back to the condensing section 129 of the condenser 120. Generally, changes of the liquid refrigerant level in the measuring chamber 122*b* can be corresponded with changes of the liquid refrigerant level 128 in the condenser 120. Therefore, by measuring the liquid refrigerant level (and/or the liquid refrigerant level changes) in the measuring chamber 122*b*, the liquid refrigerant level (and/or the liquid refrigerant level changes) in the condenser 120 can be known. The chiller system 100 can also be configured to manage and/or maintain the refrigerant level in the condenser 120.

It is to be appreciated that the liquid refrigerant level measuring device 122 can be configured differently. Generally, the liquid refrigerant level measuring device 122 is a device that is configured to measure the liquid refrigerant level (and/or the liquid refrigerant level changes) in the condenser 120.

The evaporator 140 has heat exchange tubes 144 configured to be stacked from a bottom 146 of the evaporator 140. A top row 144T of the heat exchange tubes 144 generally has a height H1 from the bottom 146. In some embodiments, the evaporator 140 includes an oil return device that generally includes a spill over port 142, the heat exchanger 150 and a temperature sensor 155. The spill over port 142 is located on a side of the evaporator, and the spill over port 142 is configured to allow refrigerant (which may contain oil) inside the evaporator 140 to flow out of the spill over port 142. The spill over port 142 is generally positioned at the height H1 from the bottom 146 of the evaporator 140. The evaporator 140 has a liquid refrigerant level 147, which may be preferably configured to be sufficient to wet the top row 144T of the heat exchange tubes 144. The spill over port 142 is configured so that when the top row 144T is wetted by the refrigerant in the evaporator 140, some of the refrigerant can spill over through the spill over port 142.

The spill over refrigerant may contain an oil portion and a refrigerant portion. It is generally desirable to return the oil portion back to the compressor 110 to help lubricate the compressor 110 and also help prevent the compressor 110 from running out of oil. The heat exchanger 150 is positioned downstream of the spill over port 142, and is configured to vaporize refrigerant of the spill over refrigerant. The refrigerant portion in the spill over refrigerant is typically more preferentially vaporized in the heat exchanger 150 compared to the oil portion. Vaporizing refrigerant can help concentrate the oil portion in the spill over refrigerant. Vaporizing refrigerant can also help provide a gaseous refrigerant velocity that can help push the spill over refrigerant (and/or the oil in the refrigerant) back to the compressor 110, which may eliminate a need for a pump to drive the spill over refrigerant back to the compressor 110.

In some embodiments, the heat exchanger 150 can be a brazed plate heat exchanger, with the appreciation that other suitable types of heat exchangers can also be used, e.g. tube-in-tube heat exchanger. It will be appreciated that, the compressor 110 can be a screw compressor, a scroll compressor, or other types of compressors.

The heat exchanger 150 is generally configured to receive a heat source to help vaporize refrigerant of the spill over refrigerant from the spill over port 142, when the spill over refrigerant flows through the heat exchanger 150. In the illustrated embodiment, the heat source is refrigerant directed out of the condenser 120, which is generally warmer than the spill over refrigerant and can help vaporize refrigerant of the spill over refrigerant in the heat exchanger 150. The refrigerant directed out of the condenser 120 is then directed to the expansion device 130. When the refrigerant directed out of the condenser 120 is used to help vaporize the refrigerant of the spill over refrigerant in the heat exchanger 150, the refrigerant directed out of the condenser 120 can be further sub-cooled in the heat exchanger 150, which may help increase a capacity of the evaporator 140.

In some embodiments, the spill over refrigerant is mainly liquid refrigerant (such as about 96% to 99% the spill over refrigerant). When the liquid refrigerant rich spill over refrigerant is directed into the compressor 110, the liquid refrigerant would not be condensed in the condenser 120, which may result in parasitic loss. By using the refrigerant from the condenser to vaporize the refrigerant of the spill over refrigerant so that the refrigerant directed to the compressor 110 may be largely in a gaseous form, the parasitic loss can be reduced.

It is noted that the heat source can be any suitable heat source that can provide heat to help vaporize the refrigerant of the spill over refrigerant in the heat exchanger 150. In some embodiments, the heat source 150 may be, for example, an electric heater, hot water for example from the condenser 120 or other sources, or oil for example from an oil separator/tank (not shown). In some embodiments, the heat exchanger 150 may be configured to work as a heat sink of another cooling loop configured, for example, to cool heat generating components (e.g. electronic components) of the chiller system 100.

The temperature sensor 155 is positioned at the refrigerant line 125 exiting the heat exchanger 150 to measure a temperature of the vaporized refrigerant after flowing through the heat exchanger 150. Because the heat exchange capacity (or the size) of the heat exchanger 150 may be limited, the temperature of the vaporized refrigerant measured by the temperature sensor 155 may be affected by a flow rate of the spill over refrigerant. Generally, when the flow rate of the spill over refrigerant increases, the temperature of the vaporized refrigerant of the spill over refrigerant may decrease; while when the flow rate of the spill over refrigerant decreases, the temperature of the vaporized refrigerant of the spill over refrigerant may increase. Therefore, the temperature of the vaporized refrigerant of the spill over refrigerant can be correlated with the flow rate of the spill over refrigerant.

It is to be appreciated that since the measured temperature of the vaporized refrigerant of the spill over refrigerant correlates with the flow rate of the spill over refrigerant, it is also possible to use a flow rate meter to measure the flow rate of the spill over refrigerant directly. It is also possible to use a flow level sensor to directly measure a refrigerant level in the evaporator. However, using the temperature sensor 155 may help save the cost of an additional flow rate meter or flow level sensor.

One purpose of the systems and methods as described herein is to maintain an optimal (or desired) refrigerant level 147 in the evaporator 140. It is also to be appreciated that the liquid refrigerant level 147 in the evaporator 140 may also be measured by a refrigerant level measuring device. However, at least due to a boiling condition of the refrigerant in the evaporator 140, measuring the refrigerant level 147 in the evaporator 140 can be difficult with the refrigerant level measuring device. Therefore, it can be difficult to maintain a stable refrigerant level 147 in the evaporator 140. Systems and methods as described herein may help obtain a stable refrigerant level 147 in the evaporator 140.

In the chiller system 100, a refrigerant flow to the evaporator 140 can be controlled by an expansion device 130. Generally, opening up the expansion device 130 results in more refrigerant flowing into the evaporator 140 and raising the liquid refrigerant level 147; while closing down the expansion device 130 results in less refrigerant flowing into the evaporator 140 and reducing the liquid refrigerant level 147.

The chiller system 100 includes the controller 160. The controller 160 is configured to receive a liquid refrigerant level (and/or changes of the liquid refrigerant level) measured by the liquid refrigerant level measuring device 122, and a temperature measured by the temperature sensor 155. The controller 160 is configured to control the expansion device 130 according to the inputs from either or both of the liquid refrigerant level measuring device 122 and the temperature sensor 155.

As illustrated in FIG. 1B, the evaporator 140 has a first end 140*a* and a second end 140*b*. A refrigerant inlet is positioned close to the first end 140*a*, and the refrigerant outlet is positioned close to the second end 140*b*. The evaporator 140 has a length L1 in a longitudinal direction defined by the length L1. In operation, an oil concentration of the refrigerant inside the evaporator 140 is generally relatively higher at a location that is close to the second end 140*b* than other locations along the longitudinal direction defined by the length L1.

In the longitudinal direction, the spill over port 142 is positioned relatively close to the second end 140*b* than to the first end 140*a* along the length L1, where the oil concentration of the refrigerant may generally be relatively high. In a vertical direction defined by a height H of the evaporator 140, the spill over port 142 is positioned at a height that corresponds to about the height H1 of the top row 144T of the heat exchange tubes 144 relative to the bottom 146 of the evaporator 140. In some embodiments, the refrigerant level 147 may be configured to be just enough to wet the top 147 of the tube bundle 144 in operation. The spill over port 142 may be positioned at a height corresponding to the refrigerant level 147 that is just enough to wet the top 147.

It is appreciated that the spill over port 142 may be positioned at other locations of the evaporator 140, such as about a middle point of the length L1. The design of the evaporator 140 and/or the chiller system 100 can change, which may cause changes in the location of the relatively high oil concentration. In these embodiments, the spill over port 142 can be positioned where the oil concentration is relatively high compared to other locations in the evaporator 140.

In the illustrated embodiment, the spill over port 142 is configured to be in fluid communication with a refrigerant reservoir 180. The refrigerant reservoir 180 can be configured, for example, collect the spill over refrigerant.

Generally, the higher the refrigerant level 147 in the evaporator 142 is, the higher the flow rate of the spill over refrigerant through the spill over port 142. The lower the refrigerant level 147 is, the lower the flow rate of the spill over refrigerant through the spill over port 142. However, since the spill over port 142 is positioned at about the height H1, sometimes when the refrigerant level 147 is lower than the spill over port 142, no refrigerant may spill over through the spill over port 142.

It is to be appreciated that the embodiment as shown in FIGS. 1A and 1B is exemplary. A chiller system can be configured to have more or less components and/or different configurations as shown in FIGS. 1A and 1B.

Referring back to FIG. 1A, arrows in FIG. 1A generally illustrate refrigerant flow direction when the chiller system is operated in a cooling mode. The refrigerant is compressed by the compressor 110. The compressed refrigerant is directed to the condenser 120. The compressed refrigerant can be condensed in the condenser 120 to liquid refrigerant. The liquid refrigerant level measuring device 122 is configured to measure the liquid refrigerant level 128 (or changes in the liquid refrigerant level) in the condenser 120, and can send the measurement information to the controller 160.

The refrigerant is directed out of the condenser 120 into the expansion device 130 through the heat exchanger 150. The refrigerant is expanded by the expansion device 130, which, as a result, also reduces a temperature and a pressure of the refrigerant. The refrigerant is then directed into the evaporator 140 to exchange heat with a process fluid, such as water, flowing through the heat exchange tubes 144.

The refrigerant may be vaporized in the evaporator 140. The vaporized refrigerant may be directed into a suction line 127 of the refrigerant lines 125. The vaporized refrigerant may then be directed back to the compressor 110.

The liquid refrigerant in the evaporator 140 has the liquid refrigerant level 147. When the liquid refrigerant level 147 is sufficient to wet the top row 144T of the heat exchange tubes 144, some of the liquid refrigerant may spill over through the spill over port 142. The spill over refrigerant through the spill over port 142 may contain lubricant, such as oil. The spill over refrigerant is directed into the heat exchanger 150. The heat exchanger 150 can be configured to receive a heat source to vaporize refrigerant in the spill over refrigerant, for example, to a superheat temperature. The oil portion is generally not vaporized in the heat exchanger 150 and remains in a liquid form. The oil portion and the vaporized refrigerant can be directed back to the suction line 127. Directing the oil back to the suction line 127 can help manage oil in the refrigerant in the evaporator 140 and prevent the compressor 110 from running out of oil.

The temperature sensor 155 is configured to measure the temperature of the vaporized refrigerant of the spill over refrigerant departing the heat exchanger 150. The temperature measurement is sent to the controller 160.

The controller 160 can be configured to open up or close down the expansion device 130, so as to regulate refrigerant flow to the evaporator 140. Regulating the refrigerant flow to the evaporator 140 can result in changes of the liquid refrigerant level 147 in the evaporator 140, as well as the refrigerant level 128 in the condenser 120. Therefore, the controller 160 can also regulate a refrigerant distribution between the condenser 120 and the evaporator 140.

The controller 160 can be configured to operate the chiller system 100 in multiple operation modes. For example, in a mode to maintain a refrigerant level 128 in the condenser 120, the controller 160 can be configured to control the expansion device 130 so that the liquid refrigerant level 128 in the condenser 120 measured by the liquid refrigerant level measuring device 122 stays roughly the same. When the liquid refrigerant level 128 measured by the liquid refrigerant level measuring device 122 goes up, the controller 160 can be configured to open up the expansion device 130 to allow more refrigerant to flow into the evaporator 140. Conversely, when the liquid refrigerant level 128 measured by the liquid refrigerant level measuring device 122 goes down, which indicates that the liquid refrigerant level 128 in the condenser 120 decreases, the controller 160 can be configured to close down the expansion device 130 to limit the refrigerant flowing into the evaporator 140.

In another mode to maintain a refrigerant superheat temperature, the temperature of the vaporized refrigerant of the spill over refrigerant measured by the temperature sensor 155 is used by the controller 160 to control the expansion device 130. Because of the spill over port 142 can be positioned at a position that corresponds to a desired refrigerant level in the evaporator 140, this mode can also help maintain the liquid refrigerant level 147 in the evaporator 140. In this mode, the controller 160 can be configured to control the expansion device 130 so that the temperature of the vaporized refrigerant measured by the temperature sensor 155 stays at a relatively small superheat temperature range, such as from 1-10° C. of superheat. It is to be appreciated that the controller 160 can be configured to maintain the temperature of the vaporized refrigerant of the spill over refrigerant at other values. When the temperature measured by the temperature sensor 155 goes up, which indicates that the flow rate of the spill over refrigerant and the liquid refrigerant level 147 decrease, the controller 160 can be configured to open up the expansion device 130 so that more refrigerant can be directed into the evaporator 140. When the temperature measured by the temperature sensor 155 goes down, which indicates that the flow rate of the spill over refrigerant and the refrigerant level 147 increase, the controller 160 can be configured to close down the expansion device 130 so that less refrigerant can be directed into the evaporator 140.

The controller 160 may also be configured to operate in another mode where the controller 160 can maintain the liquid refrigerant level in the condenser 120 or the refrigerant superheat temperature measured by the temperature sensor 155. The controller 160 can also be configured to control the expansion device 130 so that the liquid refrigerant level in the condenser 120 and/or the superheat temperature measured by the temperature sensor 155 may be varied. For example, at different load conditions, the desired refrigerant levels in the condenser 120 and the evaporator 140 may be different. By using the measured liquid refrigerant level in the condenser 120 and the superheat temperature measured by the temperature sensor 155, different refrigerant distributions of the refrigerant between the condenser 120 and the evaporator 140 can be achieved.

Figure 2:
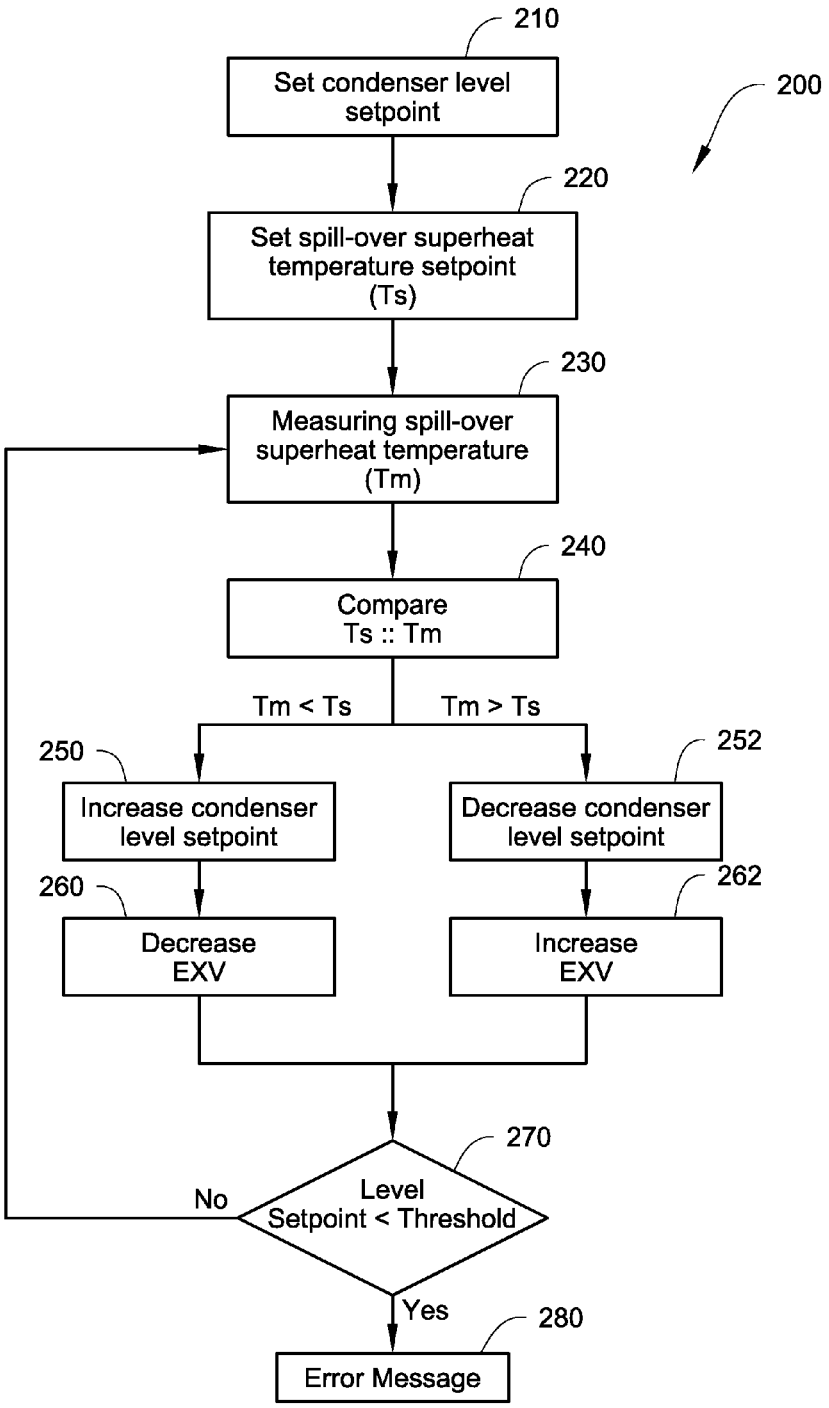
FIG. 2 illustrates a block diagram of a method to operate a chiller system, such as the chiller system as illustrated in FIGS. 1A and 1B, according to one embodiment.

FIG. 2 illustrates one method 200 of operating a chiller system, such as the chiller system 100 as illustrated in FIG. 1A. The method 200 can be executed, for example, by a controller such as the controller 160 of the chiller system 100 as illustrated in FIG. 1A. The method 200 can manage for example chiller system operation to maintain a liquid refrigerant level in a condenser (e.g. the condenser 120 in FIG. 1A) at a condenser level setpoint.

At 210, the controller is instructed to set the condenser level setpoint. The setpoint may be set by a user initially or during operation. The method 200 can also be configured to set the condenser level setpoint. (See below.) The condenser level setpoint is generally referred to as a desired liquid refrigerant level in the condenser (e.g. the refrigerant level 128 in the condenser 120 in FIG. 1A). Initially, the condenser level setpoint may be set at a level that is just sufficient to cover a subcooling section but not submerging a condensing section (such as the subcooling section 123 and the condensing section 129 in FIG. 1A), with the appreciation that the condenser level setpoint can be set at other levels. The initial setpoint can be changed by the method 200 as discussed below. The liquid refrigerant level in the condenser can be measured by a liquid refrigerant level measuring device, such as the liquid refrigerant level measuring device 122 in FIG. 1A.

At 220, the controller is instructed to set a spill over superheat temperature setpoint (Ts). The spill over superheat temperature is referred to as a desired temperature of the refrigerant vapor resulting from vaporizing refrigerant of the spill over refrigerant through a spill over port of an evaporator (such as the spill over port 142 in FIG. 1A) by a heat exchanger (such as the heat exchanger 150 in FIG. 1A). The Ts can be set by a user, or by a manufacturer of the chiller system. After Ts has been set, the method 200 generally uses the same value, although it is to be understood that the method 200 can be configured to change the Ts, for example, according to operation mode and/or load of the chiller system. The temperature of the vaporized spill over refrigerant may be correlated to a flow rate of the spill over refrigerant through the spill over port. The correlation between the temperature of the superheat refrigerant and the flow rate of the spill over refrigerant may be determined for example in a lab setting. The spill over superheat temperature setpoint Ts may correlate to a certain flow rate of the spill over refrigerant. The Ts may be determined based on a desired flow rate of the spill over refrigerant. In some embodiments, the Ts may be at a slightly superheat temperature range, such as in a range of about 1 to about 10° C. of superheat.

It is noted that by controlling the superheat temperature, the oil concentration in the spill over refrigerant may also be controlled. Generally, the higher the superheat temperature, the higher the oil concentration is. In some embodiments, for example, when the spill over refrigerant leaves the evaporator, the oil concentration in the spill over refrigerant is about 1% to about 4%. Refrigerant in the spill over refrigerant can be vaporized in the heat exchanger downstream of the spill over port. In one embodiment, when the superheat temperature is about 5° C. to about 10° C., the oil concentration in the spill over refrigerant departing the heat exchanger is about 75%.

At 230, a temperature sensor (e.g. the temperature sensor 155 in FIG. 1A) is configured to measure a temperature of the vaporized refrigerant of the spill over refrigerant superheat (Tm). In some embodiments, the temperature measurement can be performed in real-time. The measured Tm value can be sent to the controller.

At 240, the controller is instructed to compare Ts and Tm. When Tm<Ts, which indicates that the flow rate of the spill over refrigerant is higher than the desired flow rate, the method 200 proceeds to 250. A relatively high flow rate of the spill over refrigerant is generally correlated to a relatively high refrigerant level in the evaporator (e.g. the refrigerant level 147 in the evaporator 140). Therefore, when Tm<Ts, it generally indicates that the refrigerant level in the evaporator may be higher than the desired level. It may be desirable to reduce the liquid refrigerant level in the evaporator and increase the refrigerant flow to the condenser.

At 250, the condenser level setpoint is increased. Since the chiller system is generally configured to maintain the liquid refrigerant level at the condenser level setpoint, when the condenser level setpoint is increased, the chiller system can be configured to increase the refrigerant level in the condenser. As a result, the refrigerant level in the evaporator can be reduced.

To increase the refrigerant level in the condenser, the method 200 proceeds to 260. At 260, the controller is instructed to close down an expansion device (i.e. the expansion device 130 in FIG. 1A) that is configured to control a refrigerant flow to the evaporator. By closing down (or fully close) the expansion device, the refrigerant flow to the evaporator is reduced. As a result, the liquid refrigerant level in the evaporator is reduced, while the liquid refrigerant level in the condenser is increased. The method 200 then proceeds to 270.

When Tm>Ts, which indicates that the flow rate of the spill over refrigerant is lower than the desired flow rate, the method 200 proceeds to 252. A relatively low flow rate of the spill over refrigerant is generally correlated to a relatively low refrigerant level in the evaporator (e.g. the refrigerant level 147 in the evaporator 140). Therefore, when Tm>Ts, it generally indicates that the refrigerant level in the evaporator may be lower than the desired level. It may be desirable to increase the liquid refrigerant level in the evaporator and reduce the refrigerant level in the condenser.

At 252, the condenser level setpoint is decreased. Since the chiller system is generally configured to maintain the liquid refrigerant level at the condenser level setpoint, when the condenser level setpoint is decreased, the chiller system can be configured to increase the refrigerant level in the evaporator. As a result, the refrigerant level in the evaporator can be increased.

To increase the refrigerant level in the evaporator, the method 200 proceeds to 262. At 262, the controller is instructed to open up (or fully open) the expansion device that is configured to control the refrigerant flow to the evaporator. By opening up the expansion device, the refrigerant flow to the evaporator is increased. As a result, the liquid refrigerant level in the evaporator is increased, while the liquid refrigerant level in the condenser is reduced. The method 200 then proceeds to 270.

The method 200 can include a refrigerant leakage check mode at 270. At 270, the condenser level setpoint is compared to a predetermined low refrigerant level threshold in the condenser. When the condenser level setpoint is lower than the predetermined low refrigerant threshold, then the method 200 proceeds to 280. At 280, an error message indicating low refrigerant level in the condenser, which may indicate possible refrigerant leakage in the chiller system, is provided.

The possibility of detecting refrigerant leakage by using the method 200 is because a total amount of the refrigerant is distributed between the evaporator and the condenser. By maintaining the vaporized refrigerant temperature Tm at Ts, the liquid refrigerant level (or the amount of the refrigerant) in the evaporator can be maintained at a relatively stable level. A low refrigerant level (or the amount of the refrigerant) in the condenser may indicate a loss of the total amount of the refrigerant, and therefore a possible refrigerant leakage, indicating the chiller may need addition of the refrigerant.

The chiller system may be initially charged with a desired total amount of the refrigerant. The total amount of the refrigerant is distributed between the condenser and the evaporator. The refrigerant level in the condenser generally is initially configured to be at an optimal level, such as for example at a level that is just sufficient to submerge the subcooling section but not submerge the condensing section. The refrigerant level in the evaporator generally may be initially configured to be just enough to wet a top of heat exchange tubes in a flooded evaporator. During operation, when refrigerant leakage exists, the total amount of the refrigerant may keep reducing. As a result, in the method 200, the condenser level setpoint (i.e. the amount of refrigerant in the condenser) may be continuously reduced so as to maintain the refrigerant level in the evaporator at the desired level. The method 200 can be configured to compare the condenser level setpoint to the predetermined low refrigerant level threshold. When the condenser level setpoint reaches or is below the level threshold, the error message is provided to remind a user to check for the refrigerant leakage and/or add refrigerant.

The Ts may be correlated to a desired refrigerant level in the evaporator and/or a desired spill over refrigerant (or in other words, oil return) flow rate from the spill over port. Generally, the higher the Ts, the higher the desired refrigerant level in the evaporator, and the higher the spill over refrigerant flow rate. It is to be appreciated that Ts can be changed, for example, based on a load condition of the chiller system and/or a desired oil return flow rate. By changing the Ts, the desired refrigerant level and/or spill over refrigerant flow rate can be achieved by the method 200.

The refrigerant levels in the condenser and the evaporator may need to be balanced depending on the operation mode of the chiller system. In some embodiments, when the load is high, it may be desirable to increase the refrigerant level in the condenser, while reduce the refrigerant level in the evaporator. When the load is low, it may be desirable to increase the refrigerant level in the evaporator, while reducing the refrigerant level in the condenser. One skill in the art can understand that the method 200 may be adapted to incorporate the refrigerant balance control in operation depending on the load conditions.

It is to be understood that the method 200 is exemplary. Other embodiments of methods to control the chiller system may include additional processes or fewer processes. For example, in some embodiments, the method may only set either the condenser level setpoint or the superheat temperature setpoint, but not both.

It is to be appreciated that the controller may integrate other inputs with the method 200 to control the chiller system. For example, in a water cooled condenser, it may be desirable to measure a temperature of the water entering the condenser, because the temperature of the water entering the condenser may affect the temperature of the refrigerant directed out of the condenser. When the temperature of the water entering the condenser is close to or lower than Tm, the refrigerant directed out of the condenser may not be able to vaporize refrigerant of the spill over refrigerant to the desired superheat temperature. In this situation, the controller may have to control the chiller system by other methods. Conversely, a higher temperature of the water entering the condenser may cause the superheat temperature of the vaporized refrigerant of the spill over refrigerant to shift higher. The method 200 may be modified to compensate the temperature shift.

It is to be appreciated that even though the embodiments as disclosed in FIGS. 1A and 1B are directed to a condenser with a subcooling section and a flooded evaporator, the embodiments as disclosed here can be adapted to be used with other types of condensers and evaporators. Generally, the spill over port can be positioned at a position that correlates to a desired refrigerant level on an evaporator. When the refrigerant level in the evaporator is at the desired refrigerant level, some of the refrigerant can spill over through the spill over tank. A heat exchanger may be configured to receive the spill over refrigerant and vaporize refrigerant of the spill over refrigerant to a slightly superheat when the vaporized refrigerant of the spill over refrigerant departs the heat exchanger. A refrigerant flow to the evaporator can be controlled so that the temperature of the vaporized refrigerant can be maintained at the superheat. Oil portion in the spill over refrigerant can be directed back to the compressor for lubrication purposes. The methods 200 may also be generally adapted to work with other condenser and evaporator configurations to maintain/change refrigerant levels in the evaporators and/or condensers, or detect refrigerant leakage.

In some embodiments, a fluid reservoir (such as the refrigerant reservoir 180) may be positioned between the spill over port and the heat exchanger. The fluid reservoir may be configured to temporarily collect the spill over refrigerant. The fluid reservoir may help add another way to control the oil return in the chiller system.

The embodiments as disclosed herein can help control chiller operation. Generally, a liquid refrigerant level measuring device (e.g. the liquid refrigerant level measuring device 122 in FIG. 1) can be used to help maintain or manage a refrigerant level in the condenser (e.g. the condenser 120 in FIG. 1) during chiller operation. A spill over oil return device of an evaporator (e.g. the evaporator 140 in FIG. 2), which may include a spill over port (e.g. the spill over port 142 in FIG. 1), a heat exchanger positioned downstream of the spill over port (e.g. the heat exchanger 150 in FIG. 1) and a temperature sensor (e.g. the temperature sensor 150 in FIG. 1), can help maintain or manage a refrigerant level in the evaporator. The spill over device may also help oil return from the evaporator, and/or refrigerant leakage detection. The combination of the liquid refrigerant level measuring device of the condenser and the spill over oil return device can help control the chiller system.

In this disclosure, the temperature of the vaporized refrigerant of the spill over refrigerant from the evaporator (e.g. the evaporator 140) measured by the temperature sensor (e.g. the temperature sensor 155) may be correlated with the flow rate of the spill over refrigerant from the evaporator. It is to be appreciated that other methods and devices can be used to measure the flow rate of the spill over refrigerant. In some embodiments, for example, temperature sensors can be configured to measure temperatures of the refrigerant flowing into and departing from a heat exchanger (e.g. the heat exchanger 150). A temperature difference between the two temperatures can also be correlated with the flow rate of, for example, the spill over refrigerant from the evaporator and therefore can be used to indicate the refrigerant level in the evaporator (e.g. the evaporator 140). Generally, any methods and devices that can measure a parameter correlated with the refrigerant flow rate may be suitable.

Aspects

Any of aspects 1-6 can be combined with any of aspects 7-27. Any of aspects 7-19 can be combined with any of aspects 20-27.

Aspect 1. A chiller system comprising:

a condenser;

an evaporator, the evaporator having a spill over port configured to allow refrigerant to spill over from the evaporator;

an expansion device configured to regulate a refrigerant flow into the evaporator;

a heat exchanger;

a heat source; and a temperature sensor;

wherein the heat exchanger is configured to receive refrigerant spilled over through the spill over port, the heat exchanger is configured to receive the heat source to vaporize the spilled over refrigerant in the heat exchanger;

the temperature sensor is configured to measure a temperature of the spilled over refrigerant when the spilled over refrigerant departs the heat exchanger;

when the temperature of the spilled over refrigerant is above a temperature threshold, the expansion device is configured to increase the refrigerant flow into the evaporator; and when the temperature of the spilled over refrigerant is below the temperature threshold, the expansion device is configured to decrease the refrigerant flow into the evaporator.

Aspect 2. The chiller system of aspect 1, wherein the spill over port is positioned at a location corresponding to a desired refrigerant level in the evaporator.

Aspect 3. The chiller system of aspects 1-2, wherein the heat source is refrigerant from the condenser.

Aspect 4. The chiller system of aspects 1-3, wherein the temperature threshold is 1 to 10° C. of superheat.

Aspect 5. The chiller system of aspects 1-4, further comprising:

a refrigerant level measuring device; wherein the refrigerant level measuring device is configured to measure a refrigerant level in the condenser;

when the refrigerant level is above a refrigerant level setpoint, the expansion device is configured to increase the refrigerant flow into the evaporator; and when the refrigerant level is below the refrigerant level setpoint, the expansion device is configured to decrease the refrigerant flow into the evaporator.

Aspect 6. The chiller system of aspects 1-5, wherein when a load of the chiller system increases, the expansion device is configured to decrease the refrigerant flow into the evaporator; and when the load of the chiller system decreases, the expansion device is configured to increase the refrigerant flow into the evaporator.

Aspect 7. A chiller system comprising:

a condenser;

an evaporator, the evaporator having a spill over port allowing refrigerant to spill over from the evaporator; and an expansion device configured to regulate a refrigerant flow to the evaporator;

a flow rate meter; wherein the flow rate meter is configured to measure a flow rate of the spill over refrigerant from the spill over port; and the expansion device is configured to be regulated according to the flow rate of the spill over refrigerant from the spill over port.

Aspect 8. The chiller system of aspect 7, wherein the expansion device is configured to regulate the refrigerant flow to the evaporator so as to maintain the flow rate of the spill over refrigerant at a desired flow rate.

Aspect 9. The chiller system of aspects 7-8, wherein the expansion device is configured to increase the refrigerant flow to the evaporator when the flow rate of the spill over refrigerant is below a desired flow rate; and the expansion device is configured to decrease the refrigerant flow to the evaporator when the flow rate of the spill over refrigerant is above the desired flow rate.

Aspect 10. The chiller system of aspects 7-9, further comprising:

a heat exchanger, the heat exchanger configured to receive the spill over refrigerant through the evaporator; and a heat source; wherein heat exchanger is configured to receive the heat source to vaporize refrigerant of the spill over refrigerant.

Aspect 11. The chiller system of aspects 7-10, wherein the flow rate meter is a temperature sensor configured to measure a temperature of the vaporized refrigerant of the spill over refrigerant departing the heat exchanger.

Aspect 12. The chiller system of aspect 11, wherein the expansion device is configured to regulate the refrigerant flow to the evaporator so that the temperature of the vaporized refrigerant of the spill over refrigerant is maintained at superheat.

Aspect 13. The chiller system of aspects 11-12, wherein the temperature is between about 1 to about 10° C. superheat.

Aspect 14. The chiller system of aspects 10-13, wherein the heat source is refrigerant from the condenser.

Aspect 15. The chiller system of aspects 11-14, wherein the expansion is configured to increase the refrigerant flow to the evaporator when the temperature of the vaporized refrigerant of the spill over refrigerant departing the heat exchanger is above a desired temperature, and decrease the refrigerant flow to the evaporator when the temperature of the vaporized refrigerant of the spill over refrigerant departing the heat exchanger is below a desired temperature.

Aspect 16. The chiller system of aspects 7-15, further comprising:

a refrigerant level measuring device; wherein the refrigerant level measuring device is configured to measure a refrigerant level in the condenser;

when the refrigerant level is above a refrigerant level setpoint, the expansion device is configured to increase the refrigerant flow into the evaporator; and when the refrigerant level is below the refrigerant level setpoint, the expansion device is configured to decrease the refrigerant flow into the evaporator.

Aspect 17. The chiller system of aspects 7-16, wherein the evaporator includes a tube bundle, and the spill over port is positioned corresponding to a height of a top tube row of the tube bundle relative to a bottom of the evaporator.

Aspect 18. The chiller system of aspects 7-17, wherein the spill over port is positioned at a height that corresponds a desired liquid refrigerant level in the evaporator.

Aspect 19. The chiller system of aspects 7-18, wherein the spill over port is in fluid communication with a refrigerant reservoir.

Aspect 20. A method of operating a chiller system comprising:

allowing refrigerant to spill over through a spill over port of an evaporator of the chiller system, wherein an amount of the spill over refrigerant correlates to a refrigerant level in the evaporator;

providing a heat source to vaporize refrigerant of the spill over refrigerant;

measuring a temperature of the vaporized refrigerant of the spill over refrigerant; and changing a refrigerant flow to the evaporator so that the temperature of the vaporized refrigerant of the spill over refrigerant is maintained at the desired temperature set value.

Aspect 21. The method of aspect 20, further comprising: determining a desired temperature set value for the vaporized refrigerant of the spill over refrigerant.

Aspect 22. The method of aspects 20-21, further comprising:

positioning the spill over port at a height that corresponds to a desired liquid refrigerant level in the evaporator relative to a bottom of the evaporator.

Aspect 23. The method of aspects 20-22, wherein the desired temperature set value is in a superheat temperature range of the refrigerant.

Aspect 24. The method of aspects 20-23, wherein the desired temperature set value is 1 to 10° C. superheat.

Aspect 25. The method of aspects 20-24, further comprising:

measuring the liquid refrigerant level in the condenser; and changing the refrigerant flow to the evaporator so that the measured liquid refrigerant is maintained at a condenser liquid refrigerant level setpoint.

Aspect 26. The method of aspect 24-25, further comprising:

reducing the liquid refrigerant level setpoint in the condenser, when the temperature of the vaporized refrigerant of the spill over refrigerant increases; and increasing the liquid refrigerant level setpoint in the condenser, when the temperature of the vaporized refrigerant of the spill over refrigerant decreases.

Aspect 27. The method of aspects 23-26, further comprising:

providing an alert when the liquid refrigerant level setpoint is below a refrigerant level threshold.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What claimed is:

1. A chiller system, comprising:

a condenser;

an evaporator, the evaporator having a spill over port configured to allow refrigerant to spill over from the evaporator;

an expansion device configured to regulate a refrigerant flow into the evaporator;

a heat exchanger;

a heat source;

a temperature sensor, the heat exchanger is configured to receive refrigerant spilled over through the spill over port, the heat exchanger is configured to receive the heat source to vaporize the spilled over refrigerant in the heat exchanger, and the temperature sensor is configured to measure a temperature of the spilled over refrigerant when the spilled over refrigerant departs the heat exchanger, when the temperature of the spilled over refrigerant is above a temperature threshold, the expansion device is configured to increase the refrigerant flow into the evaporator; and when the temperature of the spilled over refrigerant is below the temperature threshold, the expansion device is configured to decrease the refrigerant flow into the evaporator; and a refrigerant level measuring device, wherein the refrigerant level measuring device includes a measuring chamber, a fluid communication passage connected from the condenser to the measuring chamber, and a return passage connected from the measuring chamber to the condenser, and is configured to measure a refrigerant level in the condenser by measuring a refrigerant level in the measuring chamber, when the refrigerant level in the condenser is above a refrigerant level setpoint, the expansion device is configured to increase the refrigerant flow into the evaporator, and when the refrigerant level in the condenser is below the refrigerant level setpoint, the expansion device is configured to decrease the refrigerant flow into the evaporator.

2. The chiller system of claim 1, wherein the spill over port is positioned at a location corresponding to a desired refrigerant level in the evaporator.

3. The chiller system of claim 1, wherein the heat source is refrigerant from the condenser.

4. The chiller system of claim 1, wherein the temperature threshold is 1 to 10° C. of superheat.

5. The chiller system of claim 1, wherein when a load of the chiller system increases, the expansion device is configured to decrease the refrigerant flow into the evaporator; and when the load of the chiller system decreases, the expansion device is configured to increase the refrigerant flow into the evaporator.

6. A chiller system, comprising:

a condenser;

an evaporator, the evaporator having a spill over port that allows refrigerant to spill over from the evaporator;

an expansion device configured to regulate a refrigerant flow to the evaporator;

a flow rate meter, the flow rate meter is configured to measure a flow rate of the spill over refrigerant from the spill over port, the expansion device is configured to be regulated according to the flow rate of the spill over refrigerant from the spill over port;

a heat exchanger, the heat exchanger configured to receive the spill over refrigerant through the evaporator;

a heat source; wherein the heat exchanger is configured to receive the heat source to vaporize refrigerant of the spill over refrigerant; and a refrigerant level measuring device, wherein the refrigerant level measuring device is configured to measure a refrigerant level in the condenser, when the refrigerant level is above a refrigerant level setpoint, the expansion device is configured to increase the refrigerant flow into the evaporator, and when the refrigerant level is below the refrigerant level setpoint, the expansion device is configured to decrease the refrigerant flow into the evaporator, wherein the flow rate meter is a temperature sensor configured to measure a temperature of the vaporized refrigerant of the spill over refrigerant departing the heat exchanger.

7. The chiller system of claim 6, wherein the expansion device is configured to regulate the refrigerant flow to the evaporator so as to maintain the flow rate of the spill over refrigerant at a desired flow rate.

8. The chiller system of claim 6, wherein the expansion device is configured to increase the refrigerant flow to the evaporator when the flow rate of the spill over refrigerant is below a desired flow rate; and the expansion device is configured to decrease the refrigerant flow to the evaporator when the flow rate of the spill over refrigerant is above the desired flow rate.

9. The chiller system of claim 6, wherein the expansion device is configured to regulate the refrigerant flow to the evaporator so that the temperature of the vaporized refrigerant of the spill over refrigerant is maintained at superheat.

10. The chiller system of claim 6, wherein the temperature is between about 1 to about 10° C. superheat.

11. The chiller system of claim 6, wherein the heat source is refrigerant from the condenser.

12. The chiller system of claim 6, wherein the expansion device is configured to increase the refrigerant flow to the evaporator when the temperature of the vaporized refrigerant of the spill over refrigerant departing the heat exchanger is above a desired temperature, and decrease the refrigerant flow to the evaporator when the temperature of the vaporized refrigerant of the spill over refrigerant departing the heat exchanger is below a desired temperature.

13. The chiller system of claim 6, wherein the evaporator includes a tube bundle, and the spill over port is positioned corresponding to a height of a top tube row of the tube bundle relative to a bottom of the evaporator.

14. The chiller system of claim 6, wherein the spill over port is positioned at a height that corresponds a desired liquid refrigerant level in the evaporator.

15. The chiller system of claim 6, wherein the spill over port is in fluid communication with a refrigerant reservoir.

16. A method of operating a chiller system comprising:

allowing refrigerant to spill over through a spill over port of an evaporator of the chiller system, wherein an amount of the spill over refrigerant correlates to a refrigerant level in the evaporator;

providing a heat source to vaporize refrigerant of the spill over refrigerant;

measuring a temperature of the vaporized refrigerant of the spill over refrigerant;

measuring, via a refrigerant level measuring device, a refrigerant level in a condenser;

changing a refrigerant flow to the evaporator, based in part on the measured refrigerant level in the condenser, so that the temperature of the vaporized refrigerant of the spill over refrigerant is maintained at a desired temperature set value;

increasing, via an expansion device, the refrigerant flow into the evaporator, when the measured refrigerant level is above a refrigerant level setpoint in the condenser; and decreasing, via the expansion device, the refrigerant flow into the evaporator when the measured refrigerant level is below the refrigerant level setpoint in the condenser;

reducing the refrigerant level setpoint in the condenser, when the temperature of the vaporized refrigerant of the spill over refrigerant increases; and increasing the refrigerant level setpoint in the condenser, when the temperature of the vaporized refrigerant of the spill over refrigerant decreases.

17. The method of claim 16, further comprising: determining the desired temperature set value for the vaporized refrigerant of the spill over refrigerant.

18. The method of claim 16, further comprising:

positioning the spill over port at a height that corresponds to a desired liquid refrigerant level in the evaporator relative to a bottom of the evaporator.

19. The method of claim 16, wherein the desired temperature set value is in a superheat temperature range of the refrigerant.

20. The method of claim 16, wherein the desired temperature set value is 1 to 10° C. superheat.

21. The method of claim 16, further comprising:

changing the refrigerant flow from the condenser to the evaporator so that the measured refrigerant level in the condenser is maintained at a condenser liquid refrigerant level setpoint.

22. The method of claim 16, further comprising:

providing an alert when the refrigerant level setpoint is below a refrigerant level threshold.

* * * * *